United States Patent [19]

Young

[11] Patent Number: 4,722,295

[45] Date of Patent: Feb. 2, 1988

[54] ARTICLE TREATING APPARATUS

[75] Inventor: Peter D. Young, Guernsey, Channel Islands

[73] Assignee: Ultraseal International Limited, Guernsey, Channel Islands

[21] Appl. No.: 854,617

[22] Filed: Apr. 22, 1986

[30] Foreign Application Priority Data

Apr. 29, 1985 [GB] United Kingdom ..... 8510798
Feb. 3, 1986 [GB] United Kingdom ..... 8602540

[51] Int. Cl.[4] ..... B05C 3/10

[52] U.S. Cl. ..... 118/416; 118/426; 118/429; 134/83; 134/133; 134/143; 134/162; 198/339.1; 198/740; 198/742

[58] Field of Search ..... 134/61, 82, 83, 133, 134/134, 143, 157, 159, 160, 162; 118/416, 426, 429; 198/339.1, 468.1, 740, 742; 68/10, 27, 210

[56] References Cited

U.S. PATENT DOCUMENTS

| | | | |
|---|---|---|---|
| 1,066,800 | 7/1913 | Curtis | 134/134 X |
| 2,645,914 | 7/1953 | Sessions | 68/10 |
| 2,986,918 | 6/1961 | Widigen | 68/210 |
| 3,095,081 | 6/1963 | Anderson | 198/468.1 |
| 3,590,905 | 7/1971 | Watts et al. | 118/426 X |
| 3,748,249 | 7/1973 | Barton | 134/134 X |
| 4,147,821 | 4/1979 | Young | 427/295 |
| 4,311,735 | 1/1982 | Young | 427/295 |
| 4,462,519 | 7/1984 | Parkell et al. | 198/740 X |
| 4,479,986 | 10/1984 | Juday | 427/295 |
| 4,537,669 | 8/1985 | McInnes | 134/134 X |

FOREIGN PATENT DOCUMENTS

| | | | |
|---|---|---|---|
| 1165626 | 10/1969 | United Kingdom . | |
| 1217521 | 12/1970 | United Kingdom . | |
| 1250675 | 10/1971 | United Kingdom . | |
| 1420698 | 2/1976 | United Kingdom . | |
| 1446083 | 8/1976 | United Kingdom . | |
| 2015601 | 9/1979 | United Kingdom . | |
| 482215 | 4/1976 | U.S.S.R. | 134/159 |

*Primary Examiner*—Philip R. Coe
*Attorney, Agent, or Firm*—Oblon, Fisher, Spivak, McClelland & Maier

[57] ABSTRACT

There is disclosed an article treating apparatus particularly apparatus for pressure-impregnating or vacuum impregnating porous articles such as metal castings. A holder for the articles or a metal basket containing them is disposed in an autoclave and can be rotated about a horizontal axis. It has a horizontal through-passageway so that articles to be treated can be simultaneously loaded at one end of the passageway and unloaded at the other end of the passageway by an indexing mechanism. The indexing mechanism has a plurality of pusher arms which can be moved laterally into the path of the articles and then moved horizontally to push the articles along rails into and out of the passageway. The holder is stopped at a predetermined rotary position in which a longitudinal slot is opposite the pusher arms so that unloading and loading may be effected simultaneously with a single movement of the indexing mechanism, a pusher arm passing completely through the slot. The lower part of the pressure vessel contains liquid impregnant and the holder can be rocked between an upper loading and unloading (and spin) position and a lower immersed position.

24 Claims, 6 Drawing Figures

ARTICLE TREATING APPARATUS

This invention relates to apparatus for treating articles with liquids or gases and has been particularly developed for handling porous articles during an impregnation process using a liquid impregnant. Although the invention is applicable to the treatment of porous articles such as wood, it has been primarily developed for impregnating metal castings, particularly cylinder blocks and other castings used in the motor industry, to seal the pores of the castings and prevent leakage of fluid when they are used. It is also particularly useful for treating sintered metal articles.

Various forms of apparatus have been proposed for impregnating porous articles and some of these are described in our published U.K. Patent Applications Nos. 2049751 and 2072231. In order to ensure good penetration of liquid impregnant into the pores of the article it is desirable to subject the article to a vacuum, then to immerse it in the impregnant while still under vacuum and then to release the vacuum so that the impregnant is forced into the pores by atmospheric pressure. The article is then removed from the impregnant, washed to remove excess impregnant, and subjected to a heat treatment to cure the impregnant (in the case of a heat-curing acrylate resin impregnant of the type with which the invention is primarily concerned). Because of the difficulties of moving the article within a sealed vacuum chamber, prior processes have generally worked on the principle of admitting impregnant to the vacuum chamber after the vacuum has been drawn. We have now devised an improved method of loading and unloading the vacuum chamber with articles to be impregnated which also permits the articles to be moved upwards and downwards out of and into a reservoir of impregnant within the vacuum chamber. In the form of the invention described in detail hereinafter, the article can be spun about a horizontal axis while still in the upper position in the vacuum chamber to remove excess impregnant by gravity and by centrifugal force. This not only cleans the article but reduces loss of impregnant, the excess impregnant dropping back directly into the reservoir. A single article can be treated but more usually a number of small articles are packed into a metal mesh basket for simultaneous treatment. The term 'article' is intended to cover such a simultaneous treatment of a number of articles.

U.S. Pat. No. 4,479,986 (Juday) describes apparatus for impregnating metal castings in which a carrier for the castings is movable vertically within a vacuum chamber so as to lower the castings into the impregnant after the vacuum has been drawn, the carrier being rotatable about a vertical axis, after being returned to its upper position, to remove excess impregnant by centrifugal force. However, rotation about a vertical axis is less effective for removing air locks during immersion and for removing excess impregnant than rotation about a horizontal axis as in the present invention since the direction in which gravity acts on the article changes as the article rotates. Furthermore, it is easier to balance the load symmetrically about the rotational axis using the present invention.

Another advantage of the apparatus of the invention as hereinafter described in detail is that it provides a plurality of work stations through which articles to be treated can be indexed. Because the articles are treated in closed chambers at each station, the indexing mechanism has to be withdrawn from them while the chambers are closed. A hydraulic pusher aligned with the path of the articles such as is used by Juday cannot be used to simultaneously unload articles from the chambers and load articles into the chambers because when it is unloading a treated article, it would be in the way of an untreated article to be loaded. With the Juday apparatus, the hydraulic pusher would have to be reciprocated twice, once for pushing the treated article from the carrier and once for pushing the untreated article into the carrier. In the apparatus described hereinafter, the problem is solved by using retractable pusher arms which can be laterally moved into the paths of the articles closely behind each article and retracted therefrom and by making provision for the pusher arms to pass through a suitably aligned longitudinal slot in the carrier during the indexing movement.

UK Patent Application No. 2015601 describes (FIG. 3) a horizontal cylindrical pressure vessel for the impregnation of timber, which contains a longitudinal support structure which can be rotated about the axis of the vessel. This structure has three parallel passageways symmetrically disposed about the rotary axis for receiving timber, the timber being loaded and unloaded through an end door in the vessel. However, no provision is made for rotating the timber about its own longitudinal axis.

According to one aspect the invention provides apparatus for handling an article comprising at least one work station including a holder for the article and means for rotating the holder; and means for loading an article into the holder and/or unloading it therefrom in a direction along the rotary axis, said means comprising an entrainment member for engaging the article from the side wherein the entrainment member can enter the holder in one or more predetermined rotary positons thereof.

According to another aspect the invention provides apparatus for the handling of articles comprising a cage open at at least one end rotatable about a substantially horizontal axis and comprising apertured end plates, longitudinal support means being provided for the articles in the cage extending between the end plates, and means for loading and/or unloading the articles comprising a longitudinally movable member arranged to pass through a slot in at least one of the end plates, the member preferably being retractable in a radial direction.

According to a further aspect the invention provides a method for indexing an article between work stations in which it is rotated in a holder about an axis generally parallel to the direction of indexing comprising using an entrainment member which laterally entrains the article and which can enter the holder in one or more predetermined rotary positions thereof.

According to yet another aspect, the invention provides apparatus for the handling of articles comprising a substantially horizontal cage open at at least one end for loading and/or unloading of the articles therein, means for rotating the cage about a first substantially horizontal axis passing axially therethrough, and means for moving the cage upwards and downwards about a second substantially horizontal axis. Preferably the apparatus has container means for liquid in which the cage is immersed in its lower position.

According to a further aspect, the invention provides apparatus for treating an article with a liquid, comprising an enclosure for carrying out the treatment, a holder for the article mounted in the enclosure for rotation relative to the enclosure about a substantially horizontal axis, means for rotating the holder within the enclosure and for stopping the rotation of the holder at a predetermined rotary position, the holder defining a substantially horizontal passageway for receiving the article such that the article will rotate with the holder and such that the article may be loaded through one end of the passageway and discharged through the other end of the passageway, and a pusher arm extending into the path of the article, the pusher arm being movable along said path to remove a treated article from the holder, the holder having a longitudinal opening at a position which, at said predetermined rotary position, corresponds to the position of the pusher arm whereby the pusher arm may enter the holder to discharge a treated article, the longitudinal opening extending from said one end of the passageway and along at least a substantial proportion of the length of the holder.

More generally the invention provides apparatus for treating articles with a liquid comprising an enclosure for carrying out the treatment; a holder for the articles mounted in the enclosure for rotation relative to the enclosure about a substantially horizontal axis; means for rotating the holder, the holder defining a substantially horizontal passageway open at at least one end for receiving the articles, such that the articles will rotate with the holder, and the axis of rotation passes through the passageway; and means for moving the holder between an upper position and a lower position, the holder being rotatable in both positions and the enclosure being such that the articles may be immensed in the liquid when the holder is in the lower position.

The invention also provides apparatus for treating articles with a liquid, comprising an openable and closable vessel for carrying out the treatment, carrier means within the vessel for carrying a holder for the articles and for rotating it relatively to the vessel about a substantially central substantially horizontal axis, the carrier means being rockable between an upper position and a lower position about a further substantially horizontal axis.

An embodiment of the invention will now be described by way of example with reference to the accompanying diagrammatic drawings in which.

Figure 1:
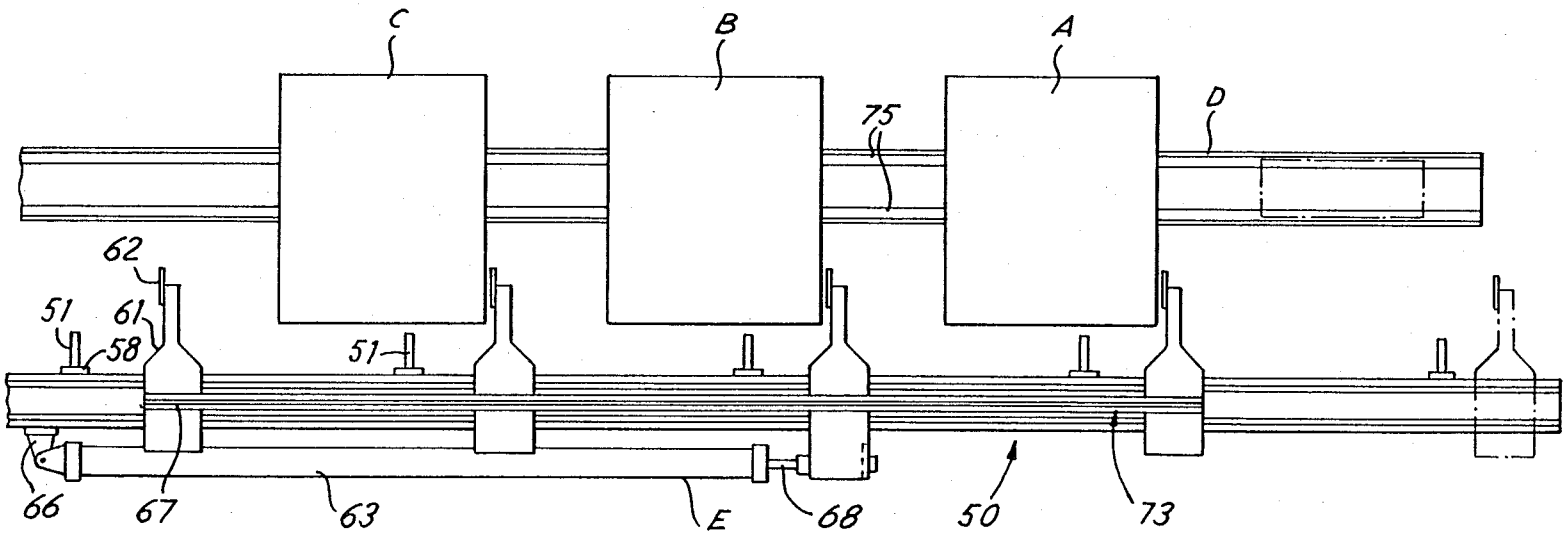
FIG. 1 is a diagrammatic plan view of an impregnation apparatus according to the invention, supporting frame members being omitted for the sake of clarity.

Referring to FIG. 1, the apparatus of the invention comprises an autoclave station A, a wash station B and a cure station C interconnected by a carriageway D along which castings or baskets containing castings are moved by an indexing mechanism E, in a manner to be described in more detail below.

Figure 2:
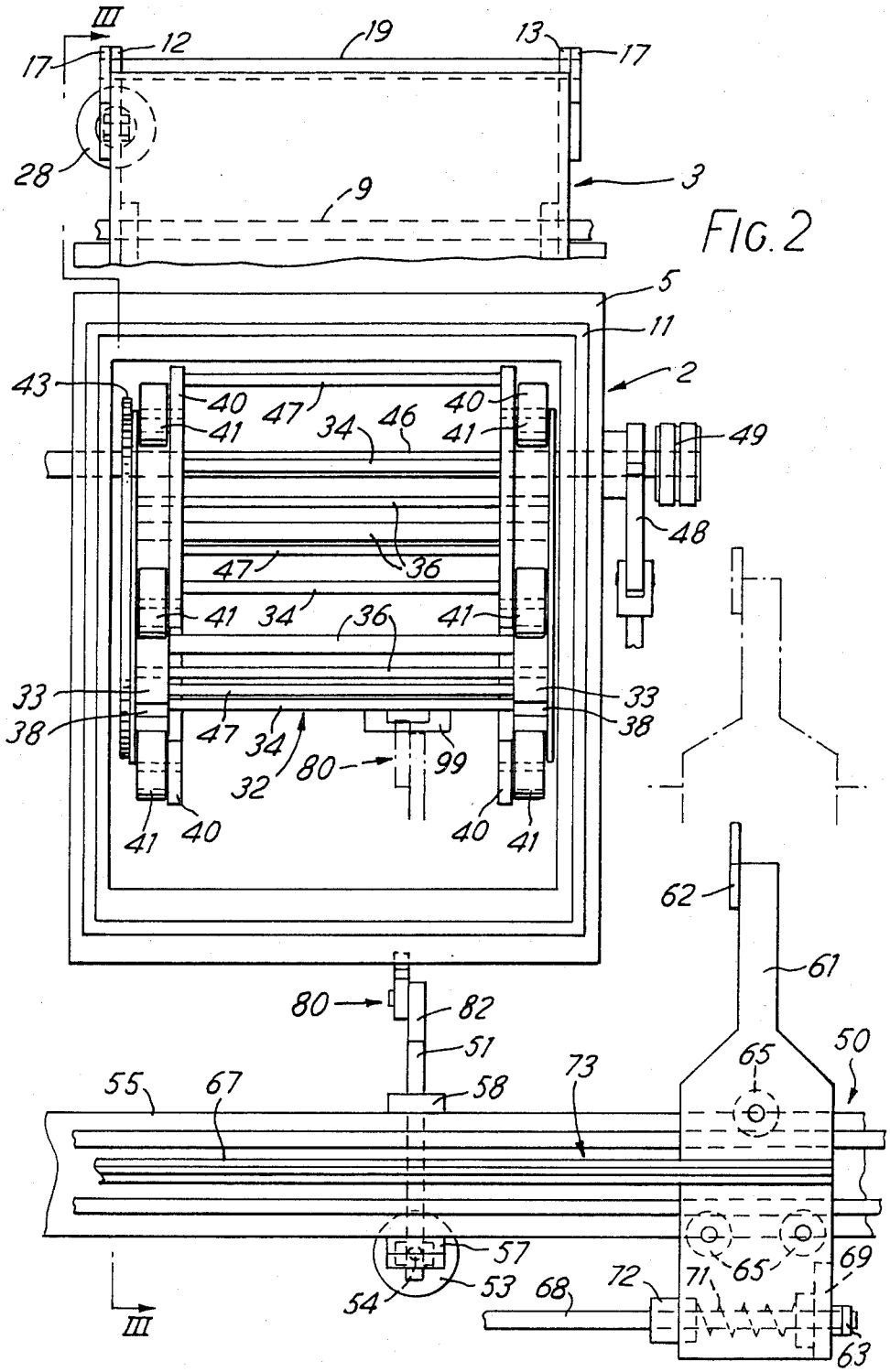
FIG. 2 is a plan view of the autoclave station A of the apparatus shown in FIG. 1 with the upper autoclave member broken away and the indexing mechanism in its retracted position.
Figure 3:
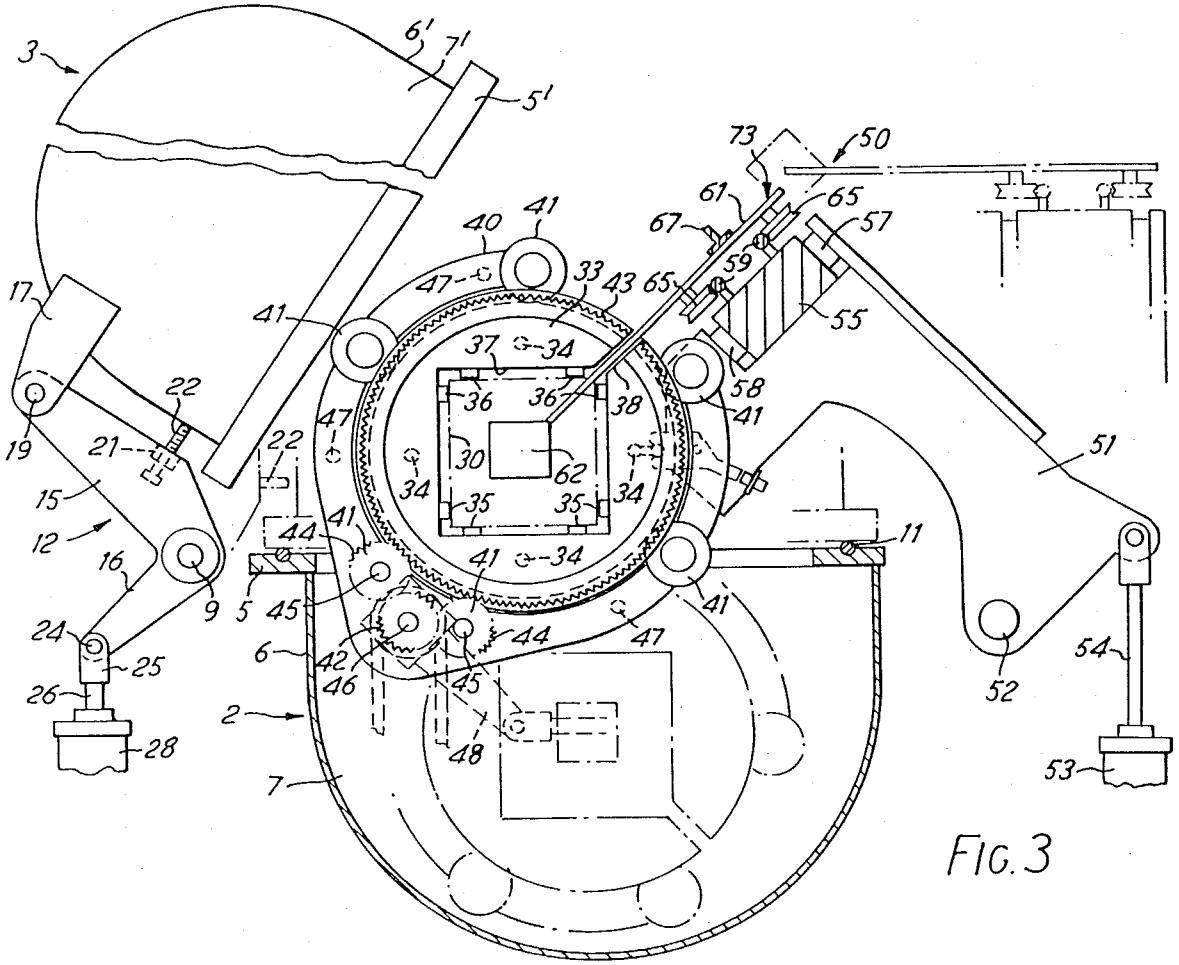
FIG. 3 is side elevation, taken on line III—III of FIG. 2, of the autoclave station of FIG. 2 with the indexing mechanism in its operative position.

Referring now to FIG. 2 and 3, the autoclave station A comprises an autoclave 1 which has a lower member 2 and an upper member 3, the latter being shown in an open position in FIG. 2 and 3. The lower member 2 is fixed and comprises a horizontal rectangular flange 5 to which is attached a semicircular channel shaped trough 6 and two vertical end walls, one of which is shown at 7. The flange 5 has a groove in which a resilient sealing strip 11 is lodged. The upper member 3 is of similar construction with flange 5', trough 6' and end walls 7' but it can be pivoted downwardly by shaft 9 to provide a closed autoclave as shown in chain-dotted lines, with flanges 5,5' mating. Secured to the shaft 9 are a pair of arms 12, 13, one of which 12 is in the form of a bell-crank lever. The other arm 13 is similar to the upper part 15 of lever 12 but has no lower part 16. The shaft 9 is carried in suitable bearings and extends substantially the whole length of the apparatus. A pair of brackets 17 extend from end walls 7' of the upper member 3 and fixedly hold a shaft 19 about which the upper ends of arms 12, 13 can pivot. Each of the arms also has a lug 21 welded to the inside thereof between the shaft 19 and the shaft 9. A bolt 22 passes through a screw threaded bore in each of the lugs 21 and engages the wall 6' of the upper member 3 in its full line position shown in FIG. 3. As shown by the chain-dotted lines the bolt 22 is spaced from the wall 6' when the autoclave is closed to permit the flange 5' to seat properly on the seal 11. The lower part 16 of arm 12 is pivotally connected at 24 to a clevis 25 on the piston rod 26 of a hydraulic piston-cylinder assembly 28 which is pivotally mounted on the frame of the apparatus at its lower end. Extension of the assembly 28 thus closes the autoclave and retraction opens it. A vacuum line (not shown) can apply a vacuum to the upper part of the autoclave and the lower member 2 is, in use, substantially full of liquid impregnant such that the liquid level is above the castings being impregnated when the castings are in the lowered position.

The basket 30 containing the castings is shown diagrammatically in chain-dotted lines in FIG. 3; it has a frame which is square in end view and rectangular in plan and side elevation view, the remainder of the walls being completed with mesh. It is housed for impregnation purpose in a cage 32 formed by two circular flanged end plates 33 connected by four tie rods 34 and pairs of rails 35 respectively at the two lower corners of central square charge and discharge openings 37 in the plates 33, corresponding pairs of rails 36 being provided at the two upper corners. Each rail pair 35, 36 consists of two rails, one connected to each side of the square opening 37 adjacent the corner. Each plate 33 has a radial slot 38 extending from its periphery to an upper corner of its opening 37, to assist charge and discharge as described below. Each plate 33 is rotatably carried by a respective C-shaped yoke 40 which carries six symmetrically disposed freely rotatably rollers 41 engaging the periphery of the respective plate 33. The yokes 40 engage the insides of the plates 33 to axially locate the cage 32 and the use of six rollers ensures proper centering even when a roller is opposite slot 38. Secured to the left plate 33 in FIG. 2 is a gear ring 43 which has a through radial slot at a position corresponding to the slots 38. Meshing with the gear ring 43 are two gears 44 mounted for free rotation on stub shafts 45 on the left hand yoke 40; these stub shafts 45 also carry lower rollers 41 inwardly of the gears 24. The gears 44 are in permanent mesh with a gear 45 on a drive shaft 46. The drive shaft 46 passes through both yokes 40 and the end walls 7 and serves not only to rotate the cage 32 but also to support the yokes 40 and the cage 32 within the autoclave in cantilever fashion, the yokes 40 being interconnected by tie rods 47. So that the pivotal movement of the yokes 40 from the upper full line position to the lower chain dotted line position is independent of the rotation of the cage 32, the drive shaft 46 has a relatively rotatable sleeve thereon (not shown) which is secured to the two yokes and also passes through both end walls 7. The sleeve is operated by an arm 48 thereon which is connected to a hydraulic piston-cylinder assembly similar to piston-assembly 28. The shaft 46 is driven via a double V-belt pulley 49 by a 'piggy back' electric motor system comprising selectively operable high speed and low speed motors. The purpose of having two gears 44 is to maintain the drive and gear tooth alignment when the slot in the gear ring 43 is opposite one of the gears 44.

The indexing mechanism E for horizontally pushing baskets 30 along carriageway D and for loading and unloading them simultaneously at the three stations, A, B and C, comprises an assembly 50 pivotable between an operative position shown in full lines and a retracted position in chain-dotted lines in FIG. 3 (and vice versa in FIG. 2). Each of a plurality of brackets 51 is pivotably mounted on the frame by a pivot 52 at its lower end and the brackets 51 can be moved between the two positions by a hydraulic piston-cylinder assembly 53, the rod 54 of which is pivotally connected to a lug on one of the brackets 51. The brackets 51 are interconnected by a beam 55 which fits in a channel 56 provided in the top of each bracket 51. The channel 56 is extended longitudinally for holding the beam 55 more securely by a plate 57 welded to the back of the bracket 51 and a plate 58 welded to the front of the bracket 51 and bolted to the beam 55. The beam 55 carries a pair of longitudinal circular rails 59 along which four pusher plates 61 with vertical face plates 62 welded to their free ends can be moved by a hydraulic piston-cylinder assembly 63. The plates 61 each have three grooved rollers 65 on their underside which engage the outsides of the rails 59 and are interconnected by a beam 67 of inverted T-section welded thereto.

The hydraulic piston-cylinder assembly 63 is secured at one end to the left hand bracket 51 by a pivotal connection 66 as shown in FIG. 1. Its rod 68 passes through a hole in a depending extension 69 from one of the pusher plates 61 and is secured by a lock-nut 63 on its threaded end. A compression spring 71 is located around the rod 68 between the extension 69 and a slidable collar 72 which can abut the end of the cylinder of the assembly 63. Thus, when the mechanism E is operated to move the pusher plates 61 to the left the spring 71 is compressed and the operative ends of the plates 61 can enter the respective work stations by a short distance to properly locate the basket therein. On release of hydraulic pressure, the spring 71 serves to move the pusher plates 61 back a short distance so that they are clear of the work stations and can be lifted to their retracted positions. When the rod 68 is extended, with the mechanism in the retracted position, it pushes the carriage 73 comprising the pusher plates 61, the rollers 65 and the beam 67 joining them to the right a distance corresponding to the distance between plates 61.

The carriageway D comprises a pair of L-shaped rails 75 serving to support and guide the baskets 30 as they pass through the apparatus, the L-shape providing upstanding guide flanges at the sides of the carriageway and the baskets 30 being dimensioned to slide between the flanges. The rails 75 are vertically and horizontally aligned with the rail pairs 35 of the cage 32 but stop short of the flanges 5 so that when the autoclave is open the basket can be slid into and out of it without difficulty.

Washing station B is similar to autoclave station A except that in operation the lower member is filled with cold water instead of impregnant. Alternatively or in addition cold water sprays can be provided in the upper member. Independent controls could be provided for raising and lowering the cage and for rotating it but it is convenient to control the cage of station B by extending the shaft and sleeve of station A into station B. Cure station C is again similar but here the yokes are fixed so that the cage is not raised or lowered. However, the cage is rotated by the shaft as in stations A and B. In station C the fixed lower member of the chamber contains upwardly directed hot air inlet ducts at its ends and a downwardly directed hot air outlet duct in the middle, the hot air being supplied by a conventional air heater and fan arrangement. Alternatively hot water jets can be used.

Figure 4:
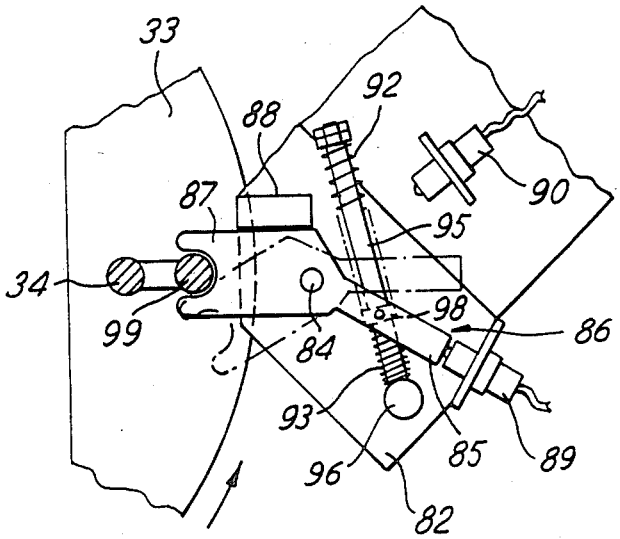
FIG. 4 is a more detailed view of part of FIG. 3.

FIG. 4 is a detail view of part of FIG. 3 showing a device 80 for ensuring that when the cage 32 stops, the slot 38 is aligned with the operative position of the pusher plates 51. The device 80 comprises a plate 82 mounted on each of the three brackets 51 which is opposite the centre of a work station. The plate 82 has a horizontal pin 84 on which a lever 86 is pivotally mounted. The lever 86 has at one end a jaw 87 which as shown in FIG. 4 is held against an abutment block 88 welded to the plate 82. At the other end 85, the lever 86 can operate proximity switches 89, 90 at the respective ends of its pivotal movement. It is biassed towards its central position by a pair of compression springs 92, 93 on a rod 95 pivotally secured to the plate 82 at 96. A collar 98 slidable on the rod 95 is pivotally attached to the lever 86, the end 85 of the lever 86 being in the form of two parallel plates to accommodate the collar 98. In operation the cage 32 first stops at a random position, the upper member of each station is raised and the indexing mechanism is moved to its operative position. The cage 32 is then rotated in the direction of the arrow in FIG. 4 till the extension 99 carried by the rod 34 engages the jaw 87 and forces it against the abutment 88 thus positively locating the cage 32. When the indexing mechanism is returned to its retracted position the direction of movement of the jaw 87 is such that it moves away from the abutment 88 which permits it to freely disengage from the extension 99.

In operation with upper members of all three stations open and baskets in all three stations and a further basket waiting to be loaded into the impregnation station, the cylinder 63 is actuated to move the pusher plates 61 to their right hand position and the indexing mechanism 50 is swung into its operative position with pusher plates 61 immediately behind the baskets by the cylinder 53. The cylinder 63 is then actuated so that the pusher plates 61 move the baskets forward by a distance such that each basket moves into the position previously occupied by the preceding one. The cylinder 53 then swings the indexing mechanism 50 back to its retracted position, the three upper members are closed and the operation of the three stations commences. A vacuum is drawn in the autoclave at station A and the cage is then lowered into the impregnant. While being lowered and while in the impregnant it is desirable to rotate the cage at say 2 r.p.m. to prevent air locks. The vacuum is then broken and after a short soak time, the cage is returned to the upper position and spun at say 100 r.p.m. to remove excess impregnant.

Thereafter, the rotation is stopped, the autoclave is opened and the indexing mechanism moved to its operative position. The motor is then reversed to lock the cage in the correct position as described above. Alternatively the cage can be stopped in its correct position by detector means, such as a proximity switch, on a bracket detecting a particular tie bar. The cycle can then be repeated. In the illustrated embodiment, the rotation of the cage is the same at all three stations, the movement of the upper members is the same at all three stations and the vertical movement of the cage is the same in stations A and B (but not C). In some cases, single articles such as engine cylinder blocks are impregnated and the shape of the cages and the disposition of the rails therein is changed accordingly.

Among the advantages of the arrangement described are the facility for rotating the article about a horizontal axis in the liquid to minimise air locks, the facility for centrifuging off excess liquid in the upper position by rotation about a horizontal axis and a pusher arrangement which can accurately position each article on the production line without the provision of spacers between articles.

Figure 5:
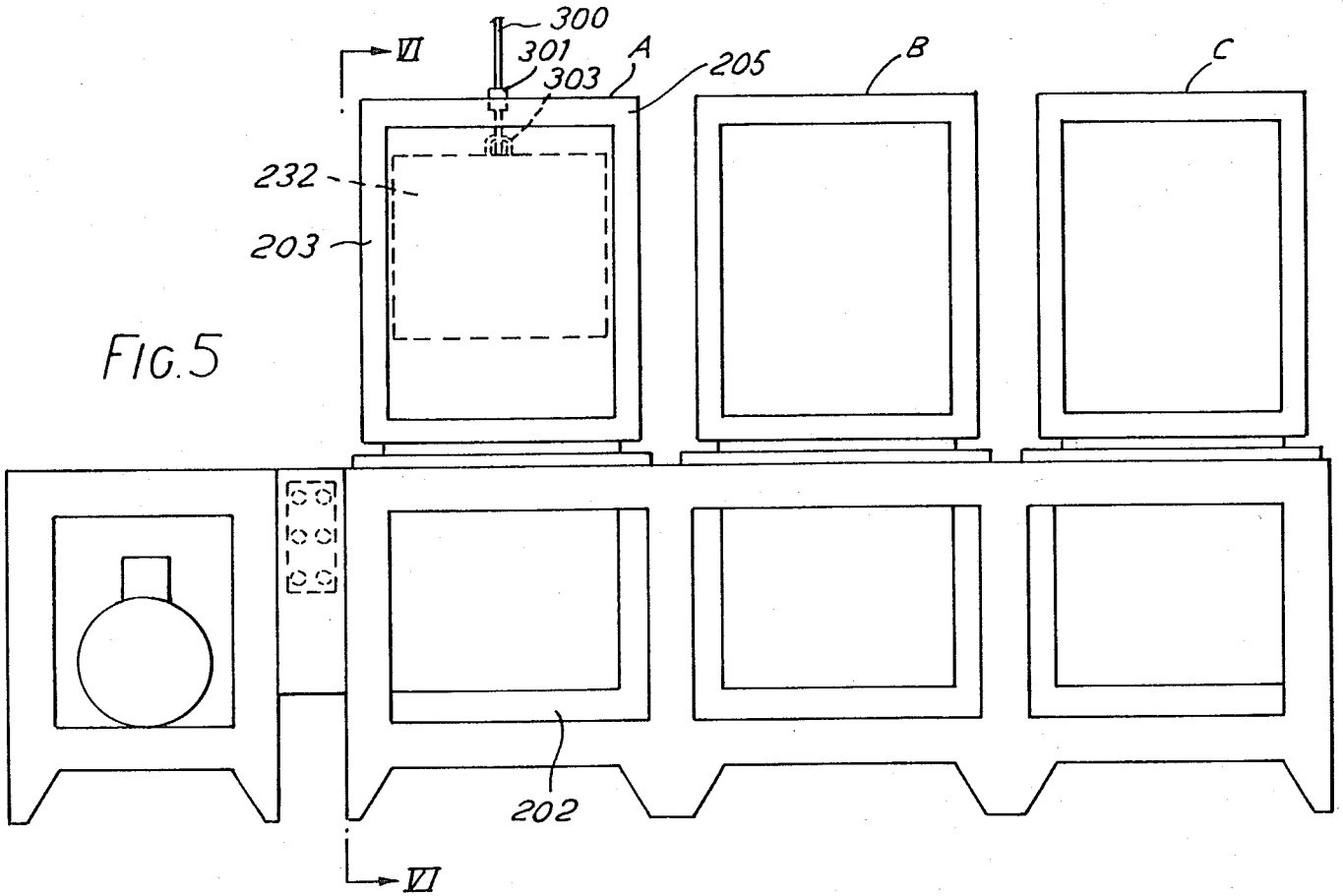
FIG. 5 is a rear elevation of a second embodiment of an impregnation apparatus according to the invention.
Figure 6:
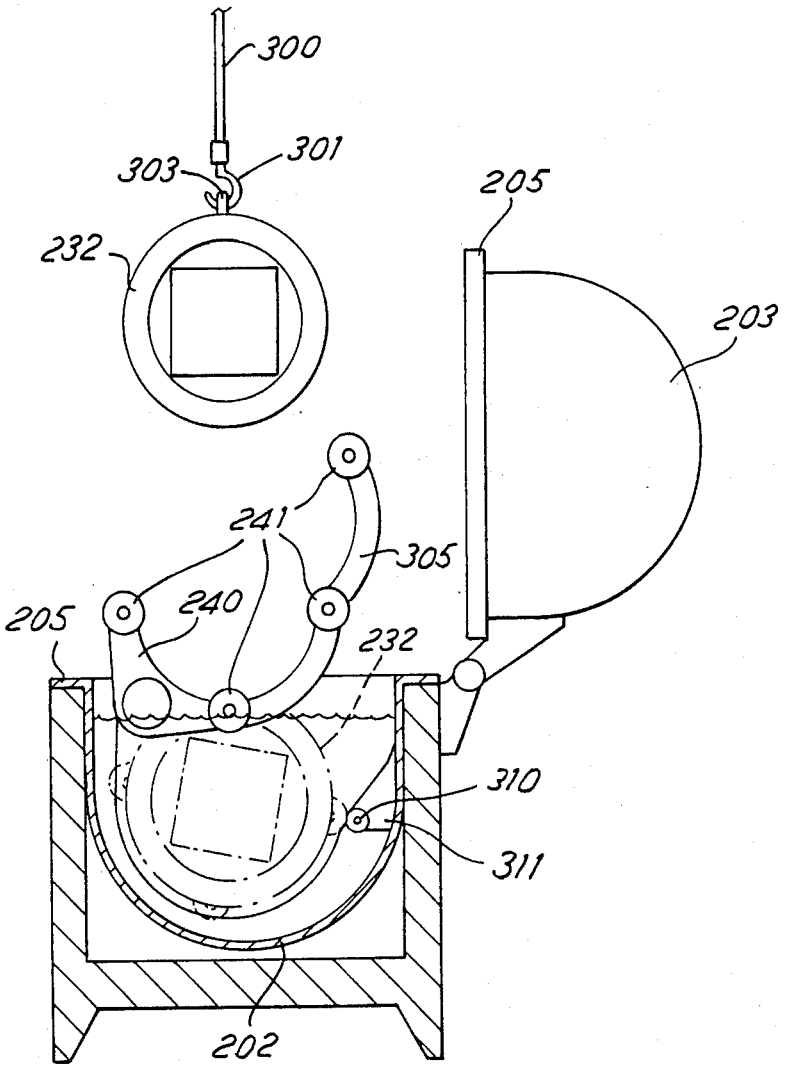
FIG. 6 is a vertical section taken on line VI—VI of FIG. 5.

The embodiment shown in FIGS. 5 and 6 is basically similar to that shown in FIGS. 1–4 but is considerably simplified. Again there is an autoclave station A, a wash station B and a cure station C, but the carriageway D and indexing mechanism E are omitted. Instead loading and unloading are effected by a conventional overhead hoist (not shown). The hoist runs on rails and raises and lowers a chain 300 to the lower end of which is attached a hook 301. The cage 232, which is basically similar to the cage 32 already described, has a ring 303 through which the hook 301 may engage to raise, lower and transport the cage 232, the basket 30 (not shown in FIGS. 5 and 6) remaining in the cage throughout. The autoclave station A, which is best shown in FIG. 6, has a lower member 202, an upper member 203 and cooperating flanges 205 similarly to those previously described. As shown in FIG. 6 part 305 of each yoke 240 can be pivoted outwardly through a limited arc to the full line position shown. This permits the hoist to lower the cage 232 into the yokes 240 so that the gear ring on the cage 232 engages with its drive gears as previously described. When the yokes 240 are rocked downwardly to the dotted line position, rollers 310 which are secured for free rotation on brackets 311 on the autoclave wall push the respective yoke portions 305 to a position where the yokes 240 securely hold the cage 232. Preferably the yoke portions 305 are spring-biassed to the full line position shown in FIG. 6. The cage 232 can then be rotated as previously described. The cage 232 can also be rotated in its upper position as it is held in the yokes 240 by gravity. When the cage 232 is to be transferred to the next station, the upper member 203 is opened and the cage 232 lifted out by re-engagement of the hook 301 with the ring 303. The hoist then transfers the cage 232 to the next work station.

In a further embodiment of the invention (not illustrated) a work station as described above is modified so that the cage is only open at one end and so that it is loaded and unloaded through this open end. Loading can be effected by a pusher member operated by a hydraulic or air cylinder outside the work station and unloading can be effected by a hydraulic or air cylinder extending through the vessel wall corresponding to the closed end of the cage and capable of extending a pusher member through a small opening in the closed end of the cage. The vessel need not be of the clam shell type previously described; it will suffice to have a closed vessel with a door in a side wall for unloading and loading baskets.

The invention is not limited to impregnation processes and, for example, it has application to such processes as washing, anodising and etching.

Although certain features have been highlighted above, the invention extends to any novel combination of features disclosed herein.

I claim:

1. Apparatus for treating articles with a liquid, comprising an enclosure for carrying out the treatment, a holder for the articles mounted in the enclosure for rotation relative to the enclosure about a substantially horizontal axis, means for rotating the holder within the enclosure, means for stopping the rotation of the holder at a predetermined rotary position, the holder defining a substantially horizontal passageway for receiving the articles such that the articles will rotate with the holder and such that the articles may be loaded through one end of the passageway and discharged through the other end of the passageway, and pusher arms extending into the path of the articles, the pusher arms being simultaneously movable along said path to remove a treated article from the holder and to supply an untreated article thereto, the holder having a longitudinal opening at a position which, at said predetermined rotary position, corresponds to the position of the pusher arms whereby a pusher arm may pass through the holder to discharge a treated article.

2. Apparatus according to claim 1 wherein means are provided for moving said pusher arms between an operative position in said path and a retracted position out of said path and for moving them longitudinally between a forward position and a rearward position.

3. Apparatus according to claim 1, wherein said axis passes through said passageway.

4. Apparatus according to claim 3, wherein said passageway is symmetrical with respect to said axis.

5. Apparatus according to claim 1, wherein said holder is movable between an upper position in which the articles may be loaded and unloaded and a lower position in which they may be immersed in the liquid.

6. Apparatus according to claim 5, wherein provision is made for rotating the holder at different speeds so that it can be rotated at a higher speed in its upper position than in its lower position.

7. Apparatus according to claim 6, wherein said holder is rotatably carried by generally C-shaped members, the opening in the C corresponding to said longitudinal opening when said holder is at said predetermined position.

8. Apparatus according to claim 7, wherein the C-shaped members are pivotally mounted so that they may be rocked between an upper position and a lower position.

9. Apparatus according to claim 8, wherein the C-shaped members are carried by a shaft which is also arranged to rotate said holder within said C-shaped members.

10. Apparatus according to claim 9, wherein the shaft has a gear thereon and the holder has a gear ring thereon which is interrupted by said longitudinal opening.

11. Apparatus according to claim 10, wherein the gear on the shaft drives the gear ring via two gears on a C-shaped member to maintain positive drive in spite of said interruption.

12. Apparatus according to claim 9 wherein the C-shaped members may be rocked by a sleeve on the shaft.

13. Apparatus according to claim 1, wherein the enclosure comprises an openable and closable vessel, the means for rotating the holder being operable from outside the vessel.

14. Apparatus according to claim 13, wherein the vessel is an autoclave and the treatment is an impregnation treatment.

15. Apparatus according to claim 14, wherein the autoclave has a lid which can be moved upwardly to open it and provide lateral access to the holder.

16. Apparatus according to claim 1, comprising a plurality of enclosures through which articles are indexed sequentially, at least one of the enclosures being as defined.

17. Apparatus for treating articles with a liquid, comprising an openable and closable vessel for carrying out the treatment, carrier means within the vessel for carrying a holder for the articles and for rotating it relatively to the vessel about a substantially central substantially horizontal axis, the carrier means being rockable between an upper position and a lower position about a further substantially horizontal axis, wherein the carrier means comprises two C-shaped members for supporting the respective ends of the holder, the openings of which are upwardly facing when the carrier means is rocked to its upper position so that the holder can be lowered into them, the C-shaped members have a pivoted portion which is in an open position when the carrier means is rocked to its upper position for receiving the holder and which is in a closed position for gripping the holder when the carrier means is rocked to its lower position.

18. Apparatus according to claim 17, wherein there is a shaft on said further axis, the carrier means being rockable about said shaft from outside said vessel when said vessel is closed and wherein rotation of said shaft from outside said vessel is arranged to rotate said holder.

19. Apparatus for treating an article with a liquid comprising an enclosure for carrying out the treatment; a holder for the article mounted in the enclosure for rotation relative to the enclosure about a substantially horizontal axis; means for rotating the holder, the holder defining a substantially horizontal passageway of substantially uniform cross-section which is open at at least one end for receiving the article, such that the article will rotate with the holder and the axis of rotation passes through the passageway; and means for rocking the holder between an upper position and a lower position about a further axis substantially parallel to said substantially horizontal axis, the holder being rotatable in both positions and the enclosure being such that the article may be immersed in the liquid when the holder is in the lower position and may be supplied to and removed from the holder when the holder is in its upper position.

20. Apparatus for treating an article with a liquid, comprising an enclosure for carrying out the treatment, a holder for the article mounted in the enclosure for rotation relative to the enclosure about a substantially horizontal axis, means for rotating the holder within the enclosure and for stopping the rotation of the holder at a predetermined rotary position, the holder defining a substantially horizontal passageway for receiving the article such that the article will rotate with the holder and such that the article may be loaded through one end of the passageway and discharged through the other end of the passageway, and a pusher arm extending into the path of the article, the pusher arm being movable along said path to remove a treated article from the holder, the holder having a longitudinal opening at a position which, at said predetermined rotary position, corresponds to the position of the pusher arm whereby the pusher arm may enter the holder to discharge a treated article, the longitudinal opening extending from said one end of the passageway and along at least a substantial proportion of the length of the holder.

21. Apparatus according to claim 19 wherein the enclosure comprises an openable and closeable vessel such that, when the holder is in said upper position and the vessel is open, the article may be supplied to and removed from the holder.

22. Apparatus according to claim 21 comprising a shaft on said further axis, the holder being rockable about said shaft from outside said vessel when said vessel is closed and wherein rotation of said shaft from outside said vessel is adapted to rotate said holder.

23. Apparatus according to claim 21 wherein said passageway is open at both ends whereby the article may be supplied to one end of the holder and removed from the other end of the holder.

24. Apparatus according to claim 1 wherein said passageway is of substantially uniform cross-section.

* * * * *